US009945258B2

(12) United States Patent
Sun et al.

(10) Patent No.: US 9,945,258 B2
(45) Date of Patent: Apr. 17, 2018

(54) SHEET METAL TURBINE HOUSING WITH CELLULAR STRUCTURE REINFORCEMENT

(71) Applicant: Ford Global Technologies, LLC, Dearborn, MI (US)

(72) Inventors: Harold Huimin Sun, West Bloomfield, MI (US); Leon Hu, Dearborn, MI (US); David R Hanna, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 637 days.

(21) Appl. No.: 14/511,987

(22) Filed: Oct. 10, 2014

(65) Prior Publication Data

US 2016/0102579 A1 Apr. 14, 2016

(51) Int. Cl.
*F01D 25/26* (2006.01)

(52) U.S. Cl.
CPC ..... *F01D 25/26* (2013.01); *F05D 2220/40* (2013.01); *F05D 2250/283* (2013.01); *F05D 2250/61* (2013.01); *F05D 2260/231* (2013.01)

(58) Field of Classification Search
CPC ..... F01D 25/26
See application file for complete search history.

(56) References Cited

U.S. PATENT DOCUMENTS 3,042,365 A * 7/1962 Curtis ..... F01D 11/125 277/414
3,874,824 A * 4/1975 Cronstedt ..... F01D 5/026 403/296
4,541,776 A * 9/1985 Schon ..... F01D 5/03 415/109
4,618,152 A * 10/1986 Campbell ..... B23K 11/0093 277/414
5,020,319 A * 6/1991 Matsuura ..... F01N 3/046 123/193.5
5,176,495 A * 1/1993 Honkomp ..... F02C 7/24 415/173.1
5,192,185 A * 3/1993 Leonard ..... F01D 11/08 415/170.1
5,238,365 A * 8/1993 Petsche ..... F01D 9/00 415/170.1

(Continued)

FOREIGN PATENT DOCUMENTS

EP 2364794 A1 9/2011
WO 2006133793 A1 12/2006

(Continued)

*Primary Examiner* — Woody Lee, Jr.
(74) *Attorney, Agent, or Firm* — Julia Voutyras; McCoy Russell LLP

(57) ABSTRACT

Systems are provided for a reinforcement element coupled to a sheet metal turbine housing that imparts desirable thermal-protective and structurally strengthening characteristics to the housing layers. In one example, a system may include a turbine comprising a housing surrounding a turbine rotor, the housing having an outer layer surrounding an inner layer at a distance to form an intermediate space between the inner and outer layers. Moreover, disposed in the intermediate space is a reinforcement element coupled to the inner and outer layers, providing strength and consistent rigidity without a significant increase in weight to the housing.

20 Claims, 4 Drawing Sheets

(56) References Cited

U.S. PATENT DOCUMENTS

| | | | | |
|---|---|---|---|---|
| 5,404,716 | A * | 4/1995 | Wells | F01N 13/102 60/272 |
| 6,109,386 | A | 8/2000 | Maus et al. | |
| 7,234,302 | B2 | 6/2007 | Körner | |
| 2011/0274542 | A1 | 11/2011 | Inoshita et al. | |
| 2012/0251315 | A1 | 10/2012 | Watanabe et al. | |
| 2012/0288364 | A1 | 11/2012 | Sadamitsu et al. | |
| 2013/0323021 | A1 | 12/2013 | Bogner et al. | |

FOREIGN PATENT DOCUMENTS

| | | | |
|---|---|---|---|
| WO | 2009106166 | A1 | 9/2009 |
| WO | 2011053513 | A2 | 5/2011 |

* cited by examiner

SHEET METAL TURBINE HOUSING WITH CELLULAR STRUCTURE REINFORCEMENT

FIELD

The present application relates to a housing for a turbocharger.

BACKGROUND/SUMMARY

Turbochargers enhance power output of an engine by directing exhaust flow from the engine to drive a turbine, which in turn drives a compressor. The compressor delivers the pressurized air into the intake manifold of the engine, and thus allows more fuel to be combusted. Since the turbine spins at high speeds, reaching 120,000 rpm or more, and is fluidically in communication with the exhaust system, the turbocharger and its housing can experience extremely high temperatures that may eventually deform various components. Because of these detrimental conditions, the housing of turbochargers may be manufactured from cast iron, which is very durable, but burdens the vehicle with significant weight that ultimately reduces fuel economy. Thus, in recent years, some manufacturers have instead opted to produce turbine housings from sheet metal.

Turbochargers comprising two layers of sheet metal provide a number of advantages over cast iron turbochargers. Because sheet metal may be manufactured into thinner pieces, the turbocharger may be lighter and thereby reduces the overall weight of the vehicle. Further still, sheet metal comparatively heats up more rapidly by the inlet exhaust gases, enabling components of the exhaust aftertreatment system, namely the catalytic converter, to reach operational (light off) temperatures more quickly on turbocharged engines, for both gasoline and diesel engines. This time to light off is prolonged when using cast iron for the turbocharger housing because of its higher heat absorption capacity.

On the other hand, the high temperature of exhaust gases, reaching temperatures upwards of 1050° C., may be more destructive to the sheet metal compared to the conventional cast iron, wherein the gathering inlet gases can distort the integrity of the sheet metal. More specifically, a turbine housing may undergo thermal expansion and thermal contraction occurring during a thermal cycle that accompanies an engine operation. When thermal deformation occurs in the turbine housing, a turbine tip clearance with the sheet metal turbine housing is typically more than doubled. In some cases, the tip clearance may increase from 0.4 to 1 mm for a turbine for light to medium duty diesel applications, which may translate into 8-12% efficiency loss or 1-3% fuel economy loss.

One example approach to address heat-induced deformation of a turbine housing is shown by Bogner et al. in U.S. patent application Ser. No. 13/984,894. Therein, a turbocharger having a coolant inlet, a cooling jacket provided in the interior of the turbine housing, and a coolant outlet is described. In this embodiment, a coolant jacket is disposed between two layers of a turbine housing.

However, the inventors herein have recognized potential issues with such systems. As one example, such cooling jackets are technically complex, require precision recasting of the turbine housing, and are correspondingly expensive to manufacture. In addition, integration with a turbocharger in a vehicle may require the turbine casing to be larger to accommodate the turbocharger, and thus lead to an increased front zone weight burden. Cooling jackets may also require complicated hydraulic and mechanical connections between the turbocharger and the internal combustion engine for the circulation of cooling fluid within the central body of the turbocharger. Even if these features may be incorporated, there may be no possibility of arranging a sufficiently large heat exchanger for liquid cooling of the turbine in the front end zone to allow dissipation of the large amounts of heat.

Accordingly, a turbine comprising a turbine housing surrounding a rotor is provided, wherein the turbine housing includes an inner layer and an outer layer of sheet metal, the outer layer surrounding the inner layer at a distance to form an intermediate space between the inner and outer layers. This intermediate space provides additional insulation and reduces heat losses. In addition, a reinforcement element comprising a body of corrugated or bellowed sheet metal having a cellular structure or a pattern is disposed in the intermediate space and coupled to at least one of, or both of, the inner and outer layers. The reinforcement element may be spaced at symmetrical or asymmetrical intervals for a limited distance or may be disposed along the entirety of the housing. In another example, the reinforcement may only be disposed at a specific location, such as between the inner and outer layers of the housing proximal to turbine blades. In this way, it is possible to maintain a threshold length between the inner layer and the rotor by strengthening the sheet metal layers closest to the turbine blades.

In one example, the reinforcement element makes it possible to dispense with materials with the capacity to bear high thermal stresses, but is burdensome in weight, such as cast iron, for the production of the turbine housing. The cellular configuration of the body of sheet metal of the reinforcement element may comprise a suitable repeating pattern. In one example, the pattern may embody a honeycomb-shaped structure, so that each face of a hexagon is in face sharing contact with the inner and/or outer layer of turbine housing. In other examples, the pattern may comprise various trigonometric geometries, such as a repeating sine wave. Further still, in other examples, the pattern may take on a generally square or triangular shape aligned in series. The reinforcement elements may be attached to the layers of the housing via spot-welding. Such patterns and attachment method provide desirable thermal-protective and structurally strengthening characteristics to the sheet metal housing layers.

Therefore, the technical effects achieved via the reinforcement element is an increase in thermal resistance and reduction of deformation in the turbine housing, and thus may help reduce an increase in distance between the turbine rotor and inner layer of the housing. As a result, loss to efficiency and fuel economy can be reduced.

The above advantages and other advantages, and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

A turbine having a sheet metal housing and a reinforcement element is described herein. In one embodiment, the turbine may include a housing having a first inner layer and a second outer layer of sheet metal, and a strengthening reinforcement element attached therebetween. The reinforcement element may be a body of corrugated or bellowed sheet metal forming a pattern. In some examples, the pattern embodies one of a hexagonal honeycomb shape, a sine wave, and other geometric repeating shape. Moreover, the reinforcement element may be spaced at intervals for a limited distance or along the entirety of the housing, and attachable to the inner and/or outer layers of the housing via spot-welding at a location at which the reinforcement element is in face-sharing contact with the inner or outer layer. By coupling the inner and outer layers with a reinforcement element having a cellular structure, it is possible to reduce thermal wear and pressure on portions of the turbine housing.

The cellular structure of the reinforcement element provides support by maintaining the insulating air gap, which reduces heat loss and promotes more rapid progression to catalytic light-off, while embodying a form that does not add a significant amount of weight. While air may be included in the gap, other embodiments may utilize a vacuum. Moreover, the cellular structure provides strength and consistent rigidity at a very low density. For example, when a reinforcement element with a body of corrugated sheet metal in a honeycomb shape is bonded to each layer of the housing, every hexagonal wall of the reinforcement element may act like the web of an I-Beam, forming a strong and rigid lightweight composite panel. Likewise, other embodiments of suitable patterns, such as geometric or trigonometric shapes, of the reinforcement element may produce similarly strengthening features to the turbine housing. In this way, a plurality of one of geometric and trigonometric patterns may increase the rigidity of the housing layers while allowing lighter gauges of metal (e.g., aluminum and steel sheet metal) to be used for specific applications.

Figure 1:
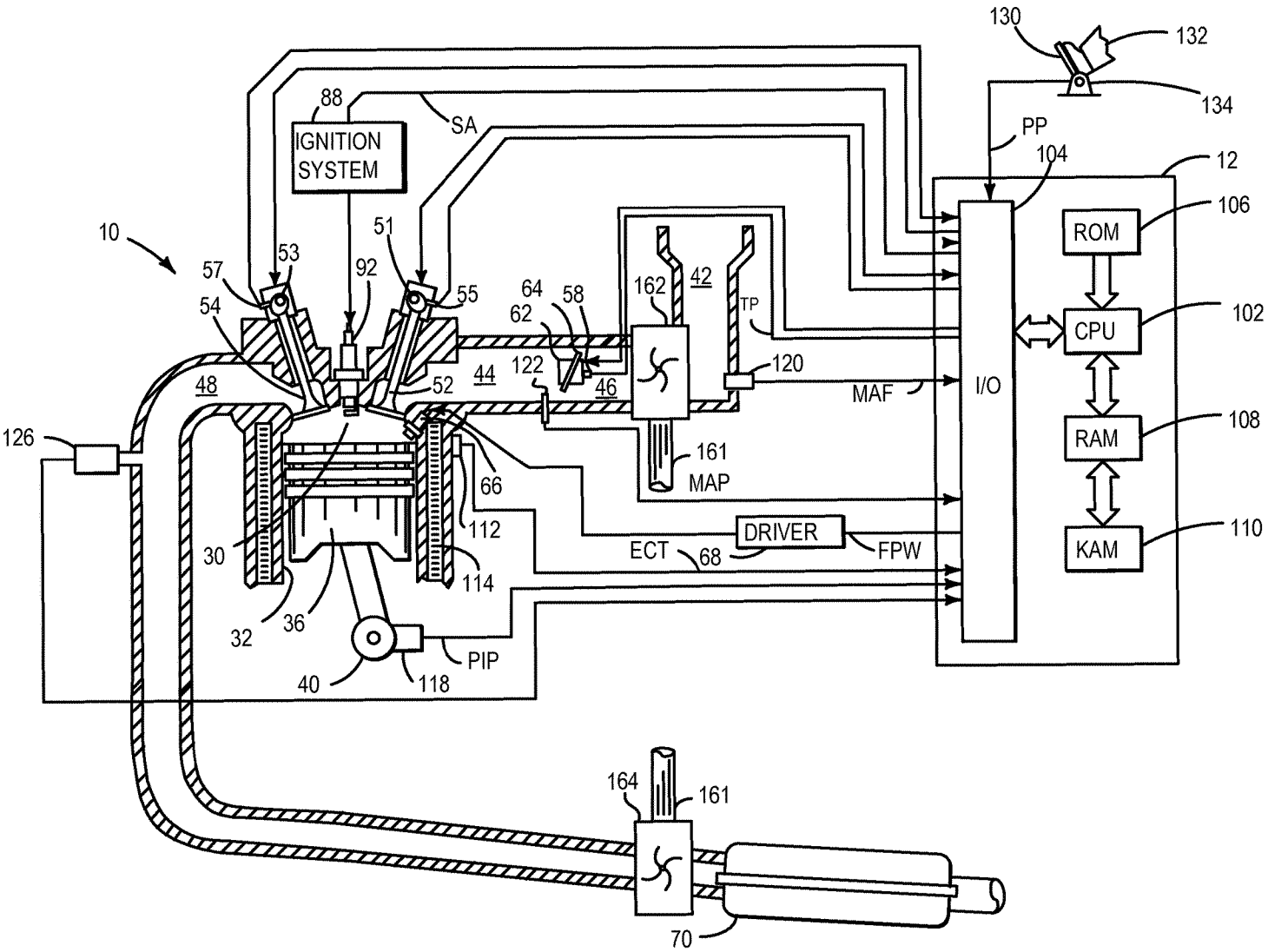
FIG. 1 shows a block diagram of a turbocharged engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into the cylinder's combustion chamber 30, which is known to those skilled in the art as direct injection. Additionally or alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. A high pressure, dual stage, fuel system may be used to generate higher fuel pressures at injectors 66. However, other suitable injectors may be utilized.

In addition, intake manifold 44 is shown communicating with optional electronic throttle 62 which adjusts a position of throttle plate 64 to control air flow from intake boost chamber 46. Compressor 162 draws air from air intake 42 to supply boost chamber 46. Exhaust gases spin turbine 164 which is coupled to compressor 162 via shaft 161. It will be appreciated that the turbine 164 is generically depicted via a box. However, as discussed in greater detail herein with regard to FIGS. 2-5, the turbine 164 has additional complexity. The compressor 162, shaft 161, and the turbine may be included in a turbocharger.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a knock sensor for determining ignition of end gases (not shown); a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof. Further, in some embodiments, other engine configurations may be employed, for example a diesel engine.

Figure 2:
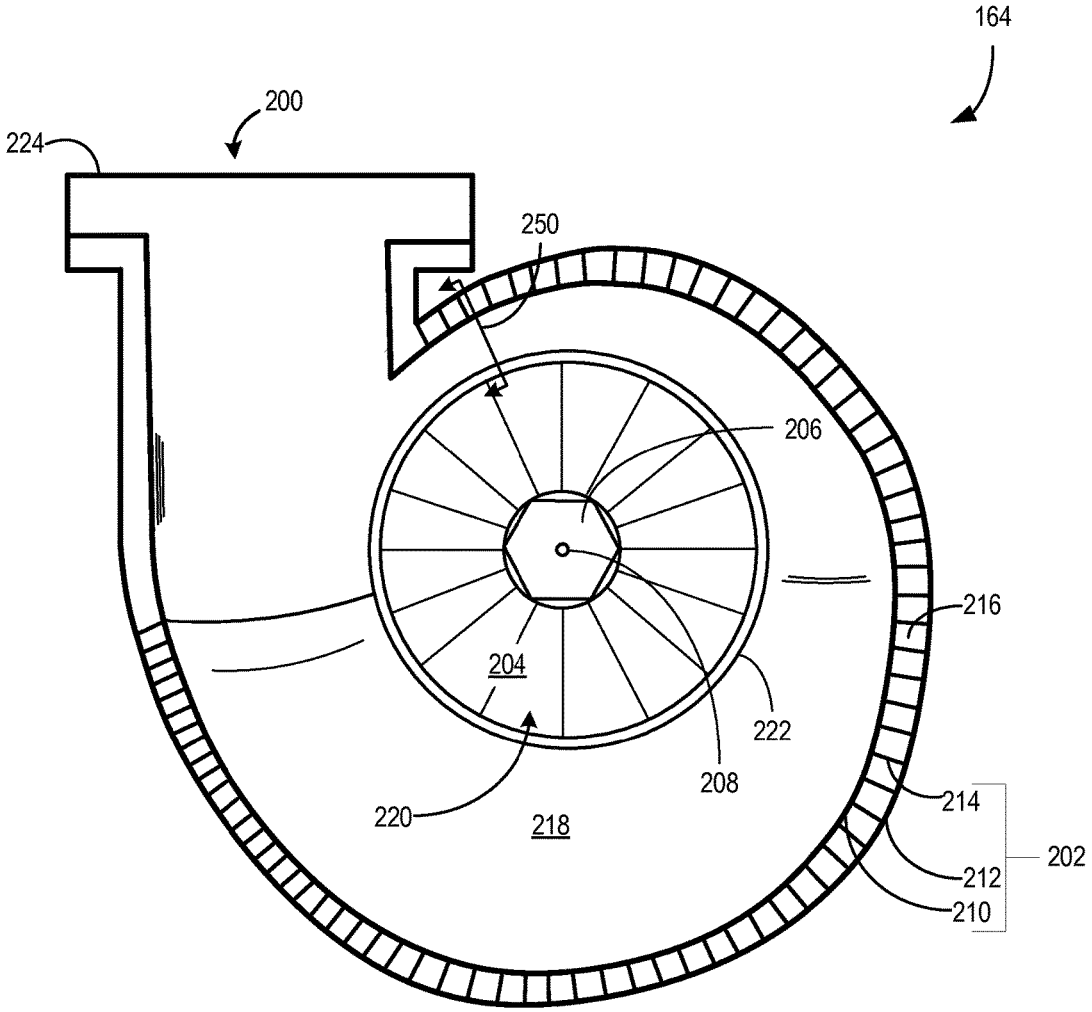
FIG. 2 shows an embodiment of a turbine in a section perpendicular to a shaft of the turbine rotor shown in FIG. 1.

FIG. 2 shows an embodiment of the turbine 164 in a section perpendicular to the shaft of the turbine rotor 204. The turbine 164 is a radial turbine, which comprises a rotor 204 arranged in a turbine housing 202, and is rotatably supported on a shaft 161. Shaft 161 is also operably connected to compressor 162. The rotor 204 rotates about rotational axis 208. As previously discussed, the turbine 164 may be fluidically coupled to the combustion chamber 30, shown in FIG. 1, and therefore may receive exhaust gases exiting a cylinder head therefrom to drive turbine 164. To allow radial inflow to rotor 204, the inlet passage 200, which merges downstream into a flow duct 218, is of spiral or volute design, ensuring that the inflow of exhaust gas to the turbine 164 is substantially radial. The turbine wheel has a hex shape 206, which may accept a socket or a wrench to facilitate attachment of the wheel to the shaft 161 as part of the casing for assembly fixturing. The rotor 204 may be coupled to the shaft 161 via friction or electron beam welding or another suitable attachment technique, in other embodiments.

The turbine 164 further includes an outlet passage 220 configured to receive exhaust gas from the turbine rotor 204. A turbine outlet flow guide 222 may be provided and included in the turbine, to be configured to direct exhaust gas from the turbine rotor 204 to downstream components. It will be appreciated that the turbine outlet flow guide 222 defines a portion of the boundary of the outlet passage 220.

In some embodiments, the turbine 164 may include a bypass passage (not shown) fluidly coupled upstream and downstream of the turbine rotor 204. A wastegate including an actuation mechanism may be positioned in the bypass passage. The wastegate may be configured to adjust the flow of exhaust gas through the bypass passage. Therefore, in some embodiments exhaust gas flow through the bypass passage may be substantially inhibited during certain operating conditions. Cutting plane 250 defines the cross-section shown in FIG. 3.

The turbine housing 202 includes an inner layer 210 and an outer layer 212, defining a first (inner) and a second (outer) layer of sheet metal, wherein the sheet metal may be a material such as steel, aluminum, etc. Housing 202 extends in a spiral around the shaft 161 and follows the flow duct 218 as far as the entry of the exhaust gas into the rotor 204. One of housing layers defines the flow path of exhaust gas through the turbine 164. To enable the turbine 164 to be attached to the exhaust passage, housing 202 may be provided with an annular inlet flange 224 positioned at a radial end of the turbine housing. Generally, the exhaust gas received at the inlet flange 224 is directed inside the turbine housing and passed along through the circular housing for spinning the turbine rotor 204.

Outer layer 212 may have substantially the same surface shape of inner layer 210. In another embodiment, it may be configured to have another shape. In some examples, outer layer 212 is substantially the same thickness as inner layer 210. In other examples, the outer layer may be thicker than the inner layer, which may result in improved insulation and reduced heat losses. Moreover, a thicker outer layer may provide an improved bursting strength. In one example, the inner layer of sheet metal may be 0.5 to 1.5 mm in thickness, which is surrounded by an outer thicker sheet metal layer having a thickness in the range of 1.5 to 5 mm. Thus, in some embodiments, the outer sheet metal layer may optionally be up to 3 times as thick as the inner layer. In some embodiments, the distance between the inner and outer layers of sheet metal is at least 1 mm to a maximum of approximately 8 mm. For example, the distance is in a range of 2 mm to 5 mm. The space formed between the outer and inner layers may serve as an intermediate space, discussed below.

As may be seen in FIG. 2, the outer layer is substantially uniformly spaced from the inner sheet metal layer over an entirety of the housing. For technical reasons of shaping, smaller distances or larger distances (e.g. at areas connecting the housing to the exhaust manifold) between the inner and outer layers of the turbine housing may also be implemented. For example, the inner and outer layers may be directly coupled to one another and/or to the exhaust manifold in a gas-tight fashion at one or more locations along the housing via welding or bolting. It is also possible to use other connecting techniques, such as folding, brazing, gluing, soldering, screw connections, coupling rings, flanges, etc., or combinations of the different types of connection, for these connections instead of welding or bolting.

Each housing layer (inner and outer) may be manufactured as one piece (e.g., cast) or may comprise one or more pieces formed separately, and subsequently welded together, or attached via another suitable means. Additionally, the inner and outer layers of sheet metal may be manufactured via different techniques. For example, the outer layer 212 may be constructed via stamping or hydroforming and the inner layer 210 may be constructed via casting. Moreover, the tolerances of the casted inner layer may be more than the tolerances of the stamped outer layer. As a result, a desired flow pattern may be achieved in the turbine scrolls, thereby decreasing losses within the turbine and increasing the turbocharger's efficiency. Casting is also a less expensive manufacturing method than stamping. In this way, the turbocharger's manufacturing costs may be reduced. Other techniques that may be employed in manufacturing the inner and outer layers include forming (bending, rolling, etc.) and cutting.

As mentioned, an intermediate space 216 may be formed between the inner and outer layer of the sheet metal, having a suitable distance, such as in a range between 1 mm and 8 mm. The presence of an intermediate space may provide additional insulating properties to the housing.

Disposed between the inner layer 210 and outer layer 212 in the intermediate space 216 is at least one reinforcement element 214. Reinforcement element 214 extends radially around the rotor 204, and is coupled to the inner layer 210 and the outer layer 212 in the depicted embodiment (FIG. 2). In one embodiment, reinforcement element 214 comprises a body of corrugated or bellowed layers of a sheet metal forming a pattern. The body of the reinforcement element may comprise sheet metal with a smooth surface finish and/or a textured finished. Furthermore, the reinforcement element may be manufactured to be between 1 and 5 mm in thickness so as to be assembled with the housing without an unacceptable weight increase that would limit the reinforcement element's utility in a vehicle turbocharger.

In one example, the pattern of the reinforcement element comprises a plurality of hexagons so as to form a honeycomb-like structure. In another example, the pattern is another repeating geometric shape, such as a series of squares (as shown in FIG. 2) or triangles. In yet another example, the pattern may include a trigonometric wave, such as a sine wave.

The reinforcement element is in face-sharing contact with a first surface of the outer layer facing towards the turbine rotor and a second surface of the inner layer facing away from the turbine rotor. In one embodiment, at least one of the face-sharing contact surfaces of the reinforcement element and one of the outer or inner layer are connected by spot welding or another appropriate mechanism, so as to form a substantially immovable and permanent coupling between each shared surface at a specific location. In another embodiment, the reinforcement element may be intermittently spot-welded to a first surface of the outer layer facing towards the turbine rotor and a second surface of the inner layer facing away from the turbine rotor, such that at a first distance interval, the reinforcement element is welded to the inner layer, but not to the outer layer, and at a second distance interval, said reinforcement element is welded to the outer layer, but not the inner layer. In an alternative embodiment, any face-sharing contact surfaces between the reinforcement element and a layer of turbine housing may be spot-welded.

In addition, a plurality of separate reinforcement elements may be coupled to the inner and outer layers and distributed intermittently throughout the turbine housing. In this way, the plurality of separate reinforcement elements may be disposed at specific distance intervals along the entirety of the turbine housing, such that there are spaced surfaces that are not coupled to reinforcement elements and other spaced surfaces that are coupled to reinforcement elements. The specific distance intervals may be symmetrical or asymmetrical intervals along the turbine housing. In another example, the reinforcement elements are coupled to the inner and/or outer layer continuously along the entirety of the turbine housing. For example, in the embodiment shown in FIG. 2, the reinforcement element comprises a repeating square pattern forming an intermediate layer with respect to both inner layer 210 and outer layer 212.

Figure 3:
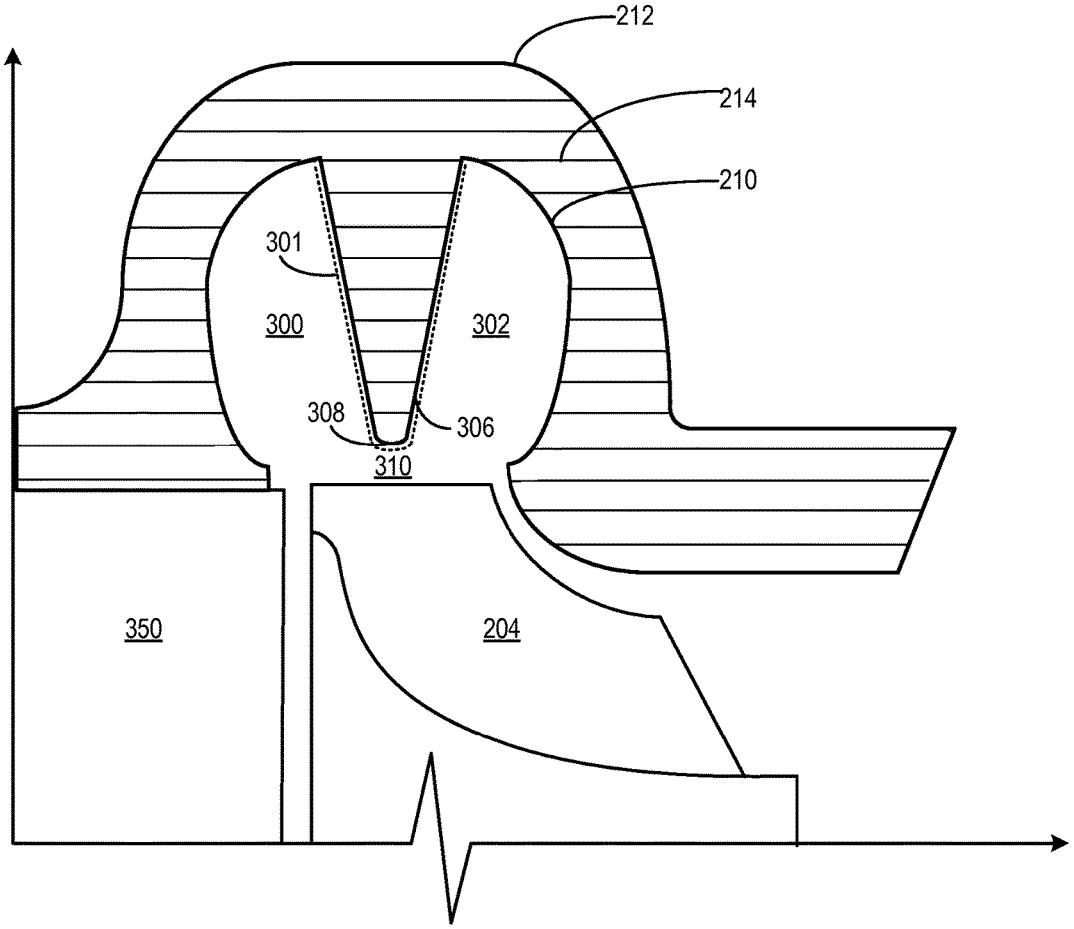
FIG. 3 shows a cross-sectional view of the turbine shown in FIG. 2.

In alternative embodiments, the plurality of reinforcement elements may be disposed at one or more locations of the turbine housing, such as a location proximal to a scroll passage of the turbine housing, as shown in FIG. 3. In this way, the reinforcement elements are disposed at particular locations deemed vulnerable to thermal stress and deformation in order to provide additional strength and support. Thus, a threshold distance may be maintained between the inner layer and the turbine rotor so that losses in turbine efficiency and fuel economy may be avoided.

In addition, the pattern of the cellular structure of the reinforcement element may be formed by, but is not limited to, one or more of the following: cutting, bending, rolling, spot welding, stamping, casting, brazing, forging, chipping, drawing, punching, and hydroforming.

FIG. 3 shows a cross-sectional view of the turbine 164 along the section of cutting plane 250 of FIG. 2. The inner layer 210 and outer layer 212 of the housing 202 are shown. Both layers extend axially, with regard to the rotational axis of the turbine 164, from a shaft housing 350 to a portion of the turbine rotor 204 in the depicted embodiment. However, in other embodiments, the inner layer 210 may include the turbine flow guide 222 and therefore may extend axially past the turbine rotor 204. The shaft housing 350 may at least partially circumferentially surround shaft 161 coupling the turbine rotor 204 to a compressor rotor included in the compressor 162 shown in FIG. 1. The shaft housing may include one or more bearings having inner and outer races, rolling elements, etc.

It will be appreciated that exhaust flow from the first scroll passage 300 and second scroll passage 302 is directed to the turbine rotor 204. The inner layer may also define a boundary of the scroll channels, such as scroll passages 300 and 302. In this embodiment, the boundaries of the first scroll passage 300 and the second scroll passage 302 are defined by a conical-shaped divider 306 extending towards the rotor from the housing. In another example, the divider may also comprise another shape. Divider 306 is contiguous with the surface of the inner layer facing towards the turbine rotor. In this way, a portion of the boundary of the first scroll passage 300 and second scroll passage 302 is defined by the divider 306 and inner layer 210.

The divider 306 may be formed from stamping, hydroforming, or casting of the inner layer of the housing. The divider 306 may also be a separate piece formed independently from housing 202, and attached via welding, molding, or a coupling flange. In yet another embodiment, no divider is provided, so that only a single scroll passage is present.

In some embodiments, a heat resistant coating 301 may be on a surface of the divider 306. The divider 306 includes an end 308 adjacent to the turbine rotor 204, defining a space 310 therebetween. In one embodiment, space 310 is less than 0.2 mm. However, in other embodiments, space 310 is another threshold distance. It will be appreciated that when the divider 306 is constructed via stamping this degree of separation of the divider 306 and the turbine rotor 204 may be achieved. Specifically, stamping may enable the divider to be constructed with a 0.2 mm tolerance, while casting may allow the divider to be constructed with a 1.5 mm tolerance. Furthermore, when stamping is used to construct the divider 306, the width of the divider may be decreased when compared to manufacturing techniques such as casting. When the width of the divider is decreased, exhaust gas is more efficiently delivered to the turbine, thereby decreasing losses and increasing the turbine's efficiency.

However, space 310 between the rotor 204 and the divider 306 may increase in distance due to high thermal strain. This leads to increased thermal and pressure losses in the turbine, thereby reducing the turbine's pulse capture and efficiency. Therefore, the reinforcement element 214 disposed at a location proximal to the divider may serve to prevent or retard this undesirable increase in space 310.

Figure 4A:
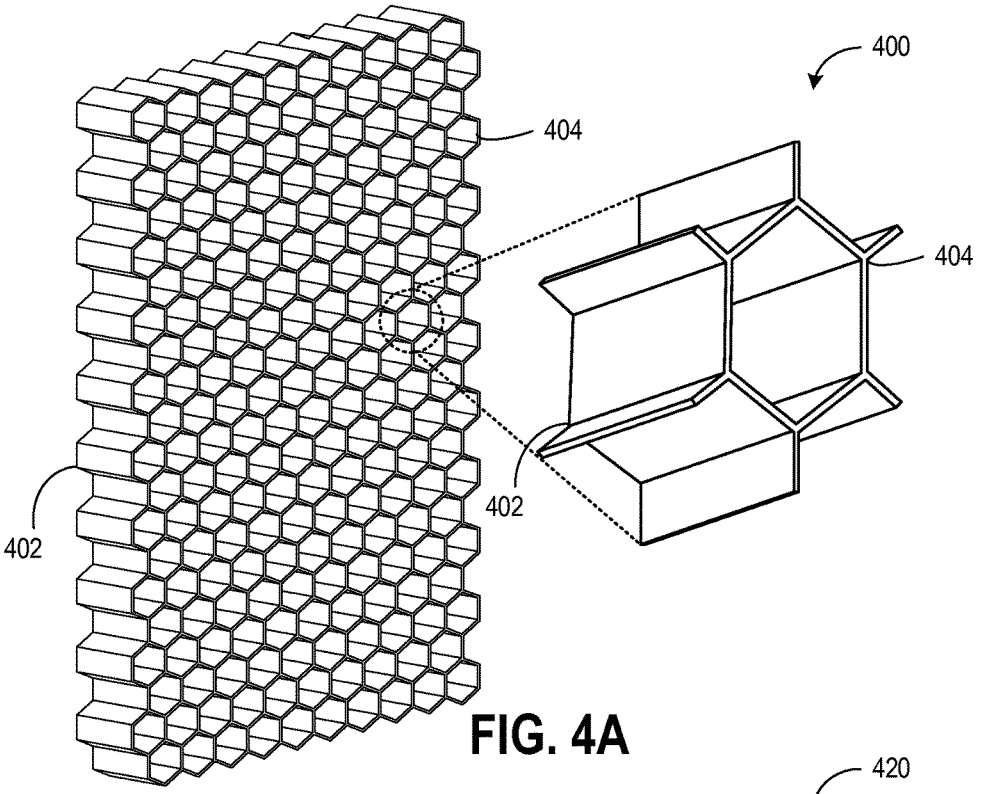
FIGS. 4A-4B show examples of patterns of a reinforcement element.
Figure 4B:
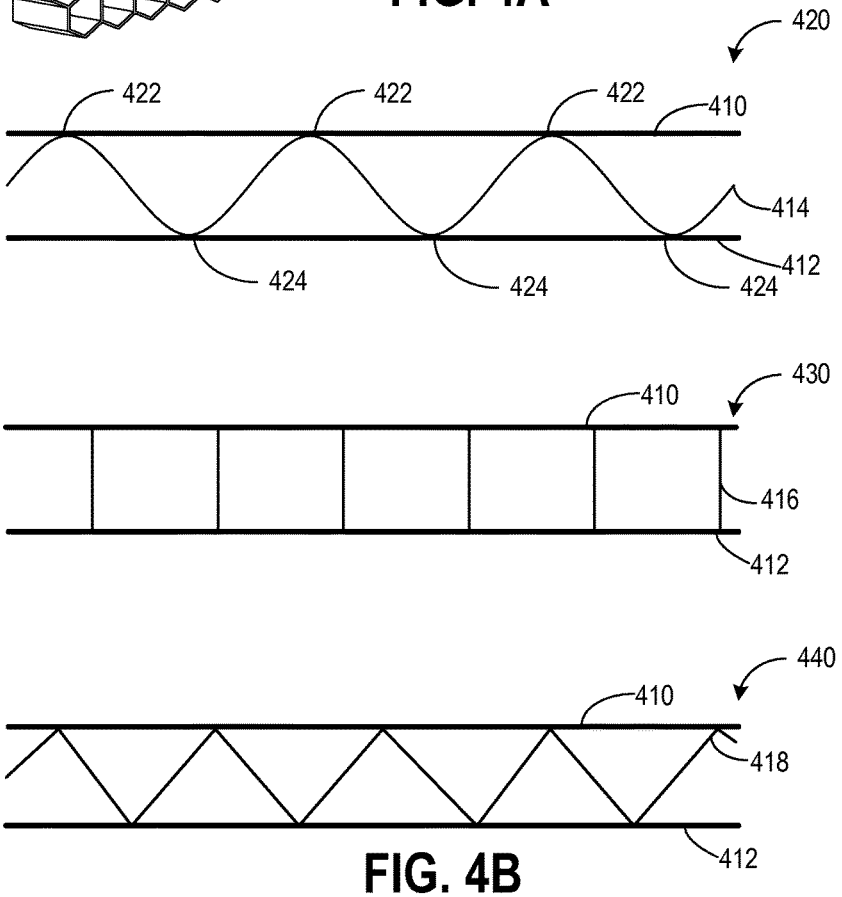

FIGS. 4A-4B show example embodiments of a reinforcement element including a body of corrugated or bellowed sheet metal having one or more patterns. The reinforcement elements illustrated in FIGS. 4A-4B are non-limiting examples of the reinforcement element 214 described above. The patterns of the reinforcement element coupled to each layer of the turbine housing helps to strengthen the sheet metal layers of the turbine housing so that the distances from the inner layer and the rotor are resistant to changes caused by physical stressors. In the specific embodiment of FIG. 4A, the pattern comprises a honeycomb or hexagonal shape, if viewed from a horizontal cross-section of the reinforcement element. Inner surface 402 of hexagonal reinforcement element 400 may be spot-welded to the inner surface of the inner layer of the housing (e.g., the surface of the inner layer facing into the intermediate space and away from the rotor), while the outer face 404 of hexagonal reinforcement element may be spot-welded to the inner surface of the outer layer of the housing (e.g., the surface of the outer layer facing into the intermediate space and towards the rotor). In this way, both layers of the housing are securely and irreversibly coupled to the reinforcement element and to one another. However, in some examples, the hexagonal reinforcement element 400 may be spot-welded to only one of the inner or outer layer. Spot-welding provides a quick (i.e. automatable), easy, and cheap method for attaching a thin sheet metal of the reinforcement element securely to one or more layers of housing, which reduces the overall costs of manufacturing compared to other methods of welding.

FIG. 4B shows additional examples of cross-sectional and partial views of a reinforcement element. In one example, the sheet metal body of the reinforcement element may comprise bellowed sheet metal forming a repeating sine wave, as seen in the cross-sectional view of reinforcement element 420. The peaks 422 and valleys 424 of sine wave 414 may be spot-welded to the inner surfaces of the outer layer 410 and inner layer 412. Again, these attachments serve to enhance the structural integrity and rigidity of the sheet metal housing body.

Below the aforementioned pattern is another embodiment of the reinforcement element with a generally square or rectangular repeating pattern if viewed as a cross-section. In this example, the reinforcement element 430 with a pattern 416 may be formed by a plurality of straight lines extending perpendicularly from the inner layer 412 to the outer layer 410, which may also be perpendicularly aligned with the line of the reinforcement element at a location where the outer layer and the reinforcement element intersect. Each end of the straight line of the reinforcement element may be attached to the inner and/or outer layers by spot-welding or another appropriate mechanism at symmetrically or asymmetrically spaced intervals.

Finally, in the last example, a reinforcement element 440 with a cross-sectional pattern of repeating triangles 418 is shown, wherein one or more corners of a triangle may be attached to the inner surface of the inner layer 412 and/or outer layer 410. In one embodiment, a single pattern may be formed by the sheet metal body of a reinforcement element. However it is possible to have more than one pattern formed by the sheet metal body of the reinforcement element. It will be appreciated that one or more patterns for a reinforcement element are not limited to the aforementioned patterns and may include various configurations and embodiments.

The pattern of the sheet metal body of the reinforcement piece may be formed by, but is not limited to: stamping, casting, spot welding, rolling, laser cutting, water jet cutting, punching with a die, perforating, embossing, etc. In some examples, the reinforcement element may be pre-molded to conform its shape to that of the inner and outer layers to be reinforced. In another example, the reinforcing element may have sufficient flexibility so as to conform to the shape of the inner and outer layers upon its application to the layers without pre-molding.

The technical effect of providing a turbine comprising a turbine housing having a reinforcement element is an overall enhanced structural support resulting in reduced thermal deformation to the turbine housing, especially in regions vulnerable to high temperatures such as at the housing proximal to the turbine rotor and scroll portion. The provision of a reinforcement components on the turbine housing leads to improved resistance to heat compared to one or more unreinforced sheet metal layers or one or more layers reinforced by a conventional reinforcing sheet without a pattern. Thus, the turbine and method disclosed herein may help prevent an increase in turbine tip clearance with sheet metal turbine housing. As a result, loss to efficiency and fuel economy will be minimized.

Thus, the systems described herein provide for a turbine comprising a housing surrounding a rotor. The housing includes an inner layer and an outer layer, the outer layer surrounding the inner layer at a distance to form an intermediate space between the inner and outer layers. The housing further includes a reinforcement element disposed within the intermediate space and coupled to at least one of the inner and outer layers for maintaining a threshold length between the inner layer and the rotor.

The reinforcement element may comprise a body of corrugated or bellowed layers of a sheet metal forming a pattern. In one example, the pattern is a honeycomb-like shape such that the cross-section of the reinforcement element is a plurality of hexagons. In another example, the pattern is a bellowing wave, such that the cross-section of the reinforcement element is a sine wave. In a further example, the pattern is a plurality of squares or triangles aligned in series.

The reinforcement element may be in face-sharing contact with a first surface of the outer layer facing toward the turbine rotor and a second surface of the inner layer facing away from the turbine rotor. In an example, the reinforcement element is coupled to one or more of the inner and outer layers by spot welding. The inner and outer layers of the housing may be connected to each other at one or more locations along the housing via welding or bolting.

In an example, the turbine further comprises a scroll portion provided in a space about the turbine rotor and configured to receive exhaust gases from an exhaust manifold and drive the turbine rotor. The inner layer may define a boundary of the scroll portion. The reinforcement element may be coupled to the outer and inner layer at a region proximal to the scroll portion.

In an example, the reinforcement element is one of a plurality of reinforcement elements, and the plurality of reinforcement elements are spaced at symmetrical intervals intermittently along the housing. In another example, the reinforcement element is disposed in the intermediate space along an entirety of the housing.

In another embodiment, a system described herein provides for a turbine comprising a housing having an inner layer and an outer layer, and an intermediate space formed therebetween. The housing further includes one or more reinforcement elements disposed in the intermediate space and coupled to each of the inner and outer layers, wherein one or more reinforcement elements is in face sharing contact with a first surface of the outer layer facing a turbine rotor and a second surface of the inner layer facing away from the turbine rotor. In one example, one or more reinforcement elements are coupled to one or more of the inner and outer layers by spot welding. In another example, one or more reinforcement elements may be spaced at even intervals along the entirety of the housing.

One or more reinforcement elements may comprise a body of corrugated or bellowed layers of a sheet metal forming a pattern having a cross-section of one of a hexagon. In another example, the pattern is a bellowing wave, such that the cross-section of the reinforcement element is a sine wave. In a further example, the pattern is a plurality of squares or triangles aligned in series.

In an alternative embodiment, a system described herein provides for a turbine, comprising a housing having an outer layer and an inner layer, and an intermediate space formed therebetween. The housing further includes a reinforcement element disposed in the intermediate space. In one example, the reinforcement element has a cross-section of a hexagon and is coupled via spot-welding to a first surface of the outer layer facing a turbine rotor and a second surface of the inner layer facing away from the turbine rotor.

In an example, the reinforcement element is one of a plurality of reinforcement elements, and the plurality of reinforcement elements are spaced at symmetrical intervals intermittently along the housing. In another example, the inner and outer layers are connected at one or more locations along the housing via welding or bolting.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A turbine comprising:

a housing surrounding a rotor of a turbocharger, the housing having:

an inner sheet metal layer being innermost of the housing and defining a boundary of a scroll portion;

an outer sheet metal layer being outermost of the housing, the outer sheet metal layer surrounding the inner sheet metal layer at a distance to form an intermediate space between the inner and outer sheet metal layers; and a sheet metal reinforcement element disposed within the intermediate space and welded or bolted to the inner sheet metal layer and the outer sheet metal layer such that a threshold length between the inner sheet metal layer and the rotor is maintained.

2. The turbine of claim 1, wherein the sheet metal reinforcement element is one of a plurality of sheet metal reinforcement elements and comprises a body of corrugated or bellowed layers of a sheet metal forming a pattern.

3. The turbine of claim 2, wherein the pattern is a honeycomb-like shape such that a cross-section of the sheet metal reinforcement element is a plurality of hexagons.

4. The turbine of claim 2, wherein the pattern is a bellowing wave, such that a cross-section of the sheet metal reinforcement element is a sine wave.

5. The turbine of claim 2, wherein the pattern is a plurality of squares or triangles aligned in series and wherein a thickness of the sheet metal reinforcement element is between 1 and 5 mm.

6. The turbine of claim 1, wherein the sheet metal reinforcement element is in face-sharing contact with a first surface of the outer sheet metal layer facing toward the rotor and a second surface of the inner sheet metal layer facing away from the rotor.

7. The turbine of claim 1, wherein the scroll portion is provided in a space about the rotor and configured to receive exhaust gases from an exhaust manifold and drive the rotor.

8. The turbine of claim 7, wherein the sheet metal reinforcement element is coupled to the outer and inner sheet metal layers at a region proximal to the scroll portion.

9. The turbine of claim 1, wherein the sheet metal reinforcement element is one of a plurality of sheet metal reinforcement elements, and wherein the plurality of sheet metal reinforcement elements is spaced at symmetrical intervals intermittently along the housing.

10. The turbine of claim 1, wherein the sheet metal reinforcement element is disposed in the intermediate space along an entirety of the housing.

11. A turbine of a turbocharger, comprising:

a housing having an inner sheet metal layer being innermost of the housing and defining a scroll portion, an outer sheet metal layer being outermost of the housing, and an intermediate space formed therebetween; and a reinforcement element disposed in the intermediate space and coupled to each of the inner sheet metal layer and the outer sheet metal layer, the reinforcement element comprising a body of corrugated or bellowed layers consisting of a sheet metal, the sheet metal forming a pattern having a cross-section of one of a hexagon, sine wave, square, or triangle.

12. The turbine of the turbocharger of claim 11, wherein the reinforcement element is in face sharing contact with a first surface of the outer sheet metal layer facing a turbine rotor and a second surface of the inner sheet metal layer facing away from the turbine rotor.

13. The turbine of the turbocharger of claim 11 further comprising additional reinforcement elements that are spaced at even intervals along an entirety of the housing.

14. The turbine of the turbocharger of claim 11, further comprising a plurality of reinforcement elements.

15. The turbine of the turbocharger of claim 11, wherein the scroll portion is provided in a space about a turbine rotor and configured to receive exhaust gases from an exhaust manifold and drive the turbine rotor.

16. The turbine of the turbocharger of claim 11, wherein the reinforcement element and the inner sheet metal layer are joined via welding, and a threshold distance between the inner sheet metal layer and a rotor is maintained.

17. A turbocharger including a turbine, comprising:

a housing having an outer sheet metal layer being outermost of the housing, an inner sheet metal layer being innermost of the housing and defining a scroll portion, and an intermediate space formed therebetween; and a sheet metal reinforcement element disposed in the intermediate space, the sheet metal reinforcement element having a cross-section of a hexagon and an outer face of the sheet metal reinforcement element coupled via spot welding to the outer sheet metal layer and, the sheet metal reinforcement element maintaining a distance between the inner and outer sheet metal layers.

18. The turbocharger including the turbine of claim 17, wherein the sheet metal reinforcement element is one of a plurality of sheet metal reinforcement elements, and wherein the plurality of sheet metal reinforcement elements is spaced at symmetrical intervals intermittently along the housing.

19. The turbocharger including the turbine of claim 17, wherein the inner sheet metal layer and the outer sheet metal layer are connected at one or more locations along the housing via welding or bolting.

20. The turbocharger including the turbine of claim 17, wherein the scroll portion is provided in a space about a turbine rotor and configured to receive exhaust gases from an exhaust manifold and drive the turbine rotor.

* * * * *